US008191625B2

(12) United States Patent
Porter et al.

(10) Patent No.: US 8,191,625 B2
(45) Date of Patent: Jun. 5, 2012

(54) MULTIPLE LAYER EXTRUSION LIMITER

(75) Inventors: Jesse Cale Porter, Duncan, OK (US); Adam K. Neer, Marlow, OK (US); Kevin Ray Manke, Marlow, OK (US); William E. Standridge, Madill, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 0 days.

(21) Appl. No.: 12/914,760

(22) Filed: Oct. 28, 2010

(65) Prior Publication Data

US 2011/0265986 A1 Nov. 3, 2011

Related U.S. Application Data

(63) Continuation-in-part of application No. 12/573,766, filed on Oct. 5, 2009.

(51) Int. Cl.
*E21B 33/12* (2006.01)

(52) U.S. Cl. ..... 166/134; 166/387

(58) Field of Classification Search ..... 166/118, 166/120, 134, 138, 179, 196, 387
See application file for complete search history.

(56) References Cited

U.S. PATENT DOCUMENTS

| | | | | |
|---|---|---|---|---|
| 2,368,928 A | | 2/1945 | King | |
| 2,836,252 A | * | 5/1958 | Lane | 277/338 |
| 3,517,742 A | * | 6/1970 | Williams | 277/338 |
| 4,151,875 A | | 5/1979 | Sullaway | |
| 4,185,689 A | | 1/1980 | Harris | |
| 4,457,369 A | | 7/1984 | Henderson | |
| 4,532,989 A | | 8/1985 | Barker | |
| 4,665,978 A | * | 5/1987 | Luke | 277/340 |
| 4,765,404 A | | 8/1988 | Bailey et al. | |
| 5,224,540 A | | 7/1993 | Streich et al. | |
| 5,271,468 A | | 12/1993 | Streich et al. | |
| 5,390,737 A | | 2/1995 | Jacobi et al. | |
| 5,540,279 A | | 7/1996 | Branch et al. | |

(Continued)

FOREIGN PATENT DOCUMENTS

EP 1 197 632 A2 4/2002

(Continued)

OTHER PUBLICATIONS

Halliburton Sales & Service Catalog 43, pp. 2561-2562 and 2556-2557 (1985).

(Continued)

*Primary Examiner* — Daniel P Stephenson
(74) *Attorney, Agent, or Firm* — John W. Wustenberg; McAfee & Taft

(57) ABSTRACT

A downhole tool has a mandrel with a sealing element disposed thereabout. The sealing element is movable from an unset position to a set position in which the sealing element engages the well. Extrusion limiters are positioned at the ends of the sealing element. The extrusion limiters have first and second layers and the first and second layers are different materials. The second layer may be made up of a plurality of discs. At least one of the discs may be a disc with an irregularly shaped outer peripheral edge and a generally circular inner peripheral edge. A plurality of the discs with the irregularly shaped outer edge may be stacked and may be stacked with a generally circular or ring-shaped segmented disc. The first and second layers are stacked and then molded into a final shape for placement at the ends of the sealing element.

17 Claims, 8 Drawing Sheets

U.S. PATENT DOCUMENTS

| | | | | |
|---|---|---|---|---|
| 5,701,959 | A | 12/1997 | Hushbeck et al. | |
| 5,839,515 | A | 11/1998 | Yuan et al. | |
| 5,857,520 | A | 1/1999 | Mullen et al. | |
| 5,984,007 | A | 11/1999 | Yuan et al. | |
| 6,102,117 | A | 8/2000 | Swor et al. | |
| 6,167,963 | B1 | 1/2001 | McMahan et al. | |
| 6,315,041 | B1 | 11/2001 | Carlisle et al. | |
| 6,394,180 | B1 | 5/2002 | Berscheidt et al. | |
| 6,491,116 | B2 | 12/2002 | Berscheidt et al. | |
| 6,598,672 | B2 | 7/2003 | Bell et al. | |
| 6,695,050 | B2 | 2/2004 | Winslow et al. | |
| 6,695,051 | B2 | 2/2004 | Smith et al. | |
| 6,708,770 | B2 | 3/2004 | Slup et al. | |
| 6,712,153 | B2 | 3/2004 | Turley et al. | |
| 6,976,534 | B2 * | 12/2005 | Sutton et al. | 166/134 |
| 7,048,066 | B2 | 5/2006 | Ringgenberg et al. | |
| 7,124,831 | B2 | 10/2006 | Turley et al. | |
| 7,350,582 | B2 | 4/2008 | McKeachnie et al. | |
| 7,434,627 | B2 | 10/2008 | Turley et al. | |
| 7,740,079 | B2 | 6/2010 | Clayton et al. | |
| 7,779,927 | B2 | 8/2010 | Turley et al. | |
| 2003/0037932 | A1 * | 2/2003 | Guillory et al. | 166/387 |
| 2004/0045723 | A1 | 3/2004 | Slup et al. | |
| 2007/0051521 | A1 | 3/2007 | Fike et al. | |
| 2007/0102165 | A1 * | 5/2007 | Slup et al. | 166/387 |
| 2009/0308604 | A1 * | 12/2009 | Corre et al. | 166/250.17 |

FOREIGN PATENT DOCUMENTS

| | | | |
|---|---|---|---|
| WO | WO 2004070163 | A1 | 8/2004 |
| WO | WO 2009019483 | A2 | 2/2009 |
| WO | WO 2009019483 | A3 | 2/2009 |

OTHER PUBLICATIONS

International Search Report and Written Opinion of the International Searching Authority dated Jan. 19, 2011, in PCT Application No. PCT/GB2010/001850.

* cited by examiner

MULTIPLE LAYER EXTRUSION LIMITER

CROSS REFERENCE TO RELATED APPLICATION

This application is a continuation-in-part of and claims the benefit of U.S. patent application Ser. No. 12/573,766, filed on Oct. 5, 2009.

BACKGROUND

This disclosure generally relates to tools used in oil and gas wellbores. More specifically, the disclosure relates to drillable packers and pressure isolation tools.

In the drilling or reworking of oil wells, a great variety of downhole tools are used. Such downhole tools often have drillable components made from metallic or non-metallic materials such as soft steel, cast iron or engineering grade plastics and composite materials. For example, but not by way of limitation, it is often desirable to seal tubing or other pipe in the well when it is desired to pump a slurry down the tubing and force the slurry out into the formation. The slurry may include for example fracturing fluid. It is necessary to seal the tubing with respect to the well casing and to prevent the fluid pressure of the slurry from lifting the tubing out of the well and likewise to force the slurry into the formation if that is the desired result. Downhole tools referred to as packers, frac plugs and bridge plugs are designed for these general purposes and are well known in the art of producing oil and gas.

Bridge plugs isolate the portion of the well below the bridge plug from the portion of the well thereabove. Thus, there is no communication from the portions above and below the bridge plug. Frac plugs, on the other hand, allow fluid flow in one direction but prevent flow in the other. For example, frac plugs set in a well may allow fluid from below the frac plug to pass upwardly therethrough but when the slurry is pumped into the well, the frac plug will not allow flow therethrough so that any fluid being pumped down the well may be forced into a formation above the frac plug. Generally, the tool is assembled as a frac plug or bridge plug. An easily disassemblable tool that can be configured as a frac plug or a bridge plug provides advantages over prior art tools. While there are some tools that are convertible, there is a continuing need for tools that may be converted between frac plugs and bridge plugs more easily and efficiently. In addition, tools that allow for high run-in speeds are desired.

Thus, while there are a number of pressure isolation tools on the market, there is a continuing need for improved pressure isolation tools including frac plugs and bridge plugs.

SUMMARY

A downhole tool for use in a well has a mandrel with an expandable sealing element having first and second ends disposed thereabout. The mandrel is a composite comprised of a plurality of wound layers of fiberglass filaments coated in epoxy. The downhole tool is movable from an unset position to a set position in the well in which the sealing element engages the well, and preferably engages a casing in the well. The sealing element is likewise movable from an unset to a set position. First and second extrusion limiters are positioned at the first and second ends of the sealing element. The first and second extrusion limiters may be comprised of a plurality of composite layers with rubber layers therebetween. In one embodiment, the extrusion limiters may comprise a plurality of layers of fiberglass, for example, fiberglass filaments or fibers covered with epoxy resin, with layers of rubber, for example, nitrile rubber adjacent thereto. The first and second extrusion limiters may have an arcuately shaped cross section and be molded to the sealing element. First and second extrusion limiters may thus comprise a plurality of first layers and second layers when the first layers are nitrile rubber and the second layers are fiberglass layers. The second layers may comprise a plurality of discs. For example, each second layer may comprise at least one generally circular or ring-shaped disc having an inner peripheral edge which may be a circular inner peripheral edge and an outer peripheral edge that is irregularly shaped. The irregular shape may be for example a generally circular outer peripheral edge with a plurality of cutouts therein. The cutouts extend radially inwardly from the outer peripheral edge towards the inner peripheral edge. The second layers may also comprise a generally circular or ring-shaped disc that is a segmented disc. In the embodiment described, the segmented disc comprises four equal sized segments each defining segment side edges. The segmented disc is stacked with the disc having the irregularly shaped outer edge and is oriented such that no side segment edge aligns with a cutout edge.

First and second slip wedges are likewise disposed about the mandrel. Each of the first and second slip wedges have an abutment end which abuts the first and second extrusion limiters, respectively. The abutment end of the first and second slip wedges preferably comprise a flat portion that extends radially outwardly from a mandrel outer surface and has a rounded transition from the flat portion to a radially outer surface of the slip wedge.

First and second slip rings are disposed about the mandrel and will ride on the slip wedges so that the first and second slip wedges will expand the first and second slip rings radially outwardly to grippingly engage casing in the well in response to relative axial movement. The first and second slip rings each comprise a plurality of individual slip segments that are bonded to one another at side surfaces thereof, Each of the slip segments have end surfaces and at least one of the end surfaces has a groove therein. The grooves in the slip segments together define a retaining groove in the first and second slip rings. A retaining band is disposed in the retaining grooves in the first and second slip rings and is not exposed to fluid in the well.

The downhole tool has a head portion that is threaded to the mandrel. The head portion may be comprised of a composite material and the threaded connection is designed to withstand load experienced in the well. In addition, the thread allows the downhole tool to be easily disassembled so that the tool may be easily converted or interchanged between a frac plug and bridge plug.

BRIEF DESCRIPTION OF THE DRAWINGS

FIG. 9 shows the stacked discs that may be used in a layer of the extrusion limiter described herein.

DETAILED DESCRIPTION OF A PREFERRED EMBODIMENT

Figure 1:
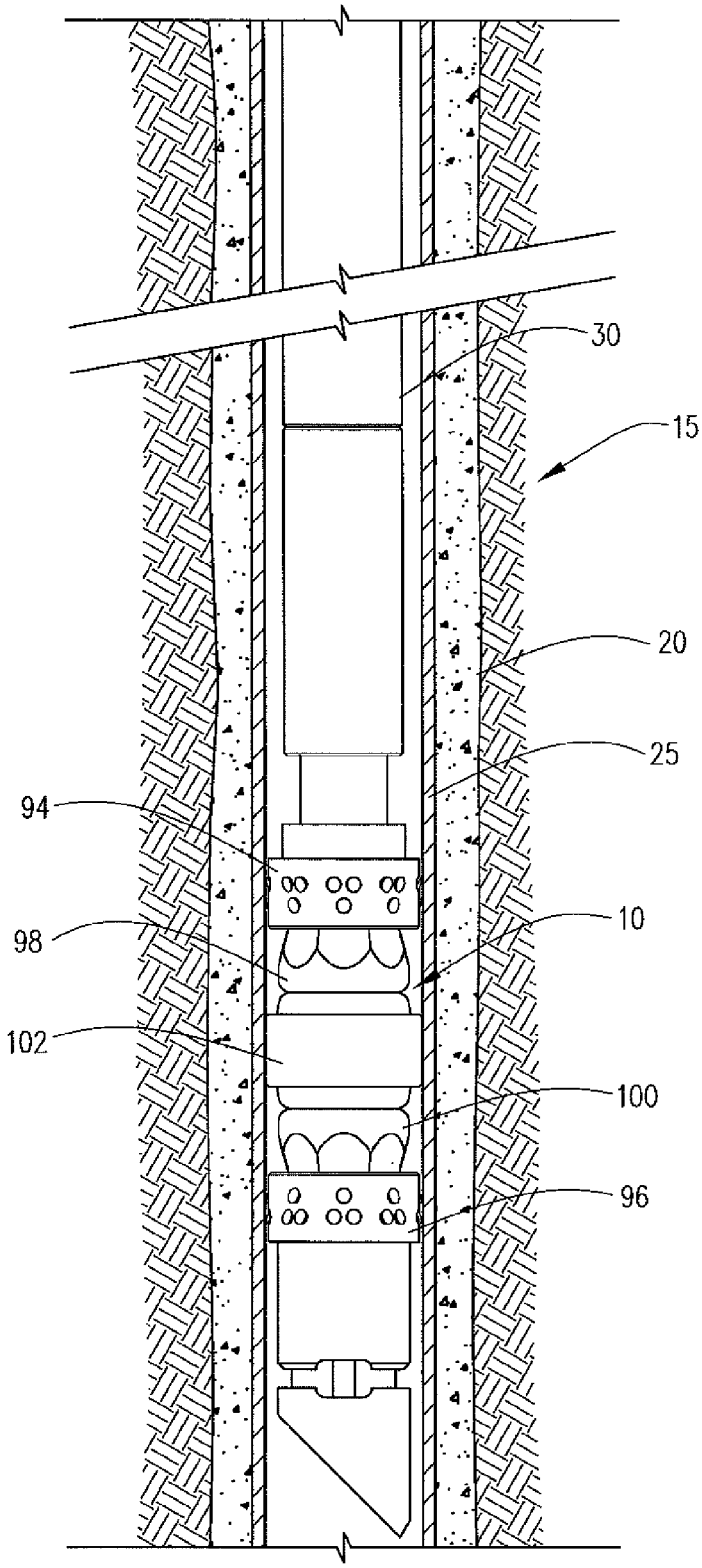
FIG. 1 schematically shows the tool in a well.

Referring now to FIG. 1, a downhole tool 10 is shown in a well 15 which comprises wellbore 20 with casing 25 cemented therein. Tool 10 may be lowered into well 15 on a tubing 30 or may be lowered on a wireline or other means known in the art. FIG. 1 shows tool 10 in its set position in the well.

Downhole tool 10 comprises a mandrel 32 with an outer surface 34 and inner surface 36. Mandrel 32 may be a composite mandrel constructed of a polymeric composite with continuous fibers such as glass, carbon or aramid, for example. Mandrel 32 may, for example, be a composite mandrel comprising layers of wound fiberglass filaments held together with an epoxy resin, and may be constructed by winding layers of fiberglass filaments around a forming mandrel. A plurality of fiberglass filaments may be pulled through an epoxy bath so that the filaments are coated with epoxy prior to being wound around the forming mandrel. Any number of filaments may be wound, and for example eight strands may be wound around the mandrel at a time. A plurality of eight strand sections wound around the forming mandrel and positioned adjacent to one another form a composite layer which may be referred to as a fiberglass/epoxy layer. Composite mandrel 32 comprises a plurality of the layers. Composite mandrel 32 has bore 40 defined by inner surface 36.

Mandrel 32 has upper or top end 42 and lower or bottom end 44. Bore 40 defines a central flow passage 46 therethrough. An end section 48 may comprise a mule shoe 48. In the prior art, the end section or mule shoe is generally a separate piece that is connected with pins to a tubular mandrel. Mandrel 32 includes mule shoe 48 that is integrally formed therewith and thus is laid up and formed in the manner described herein. Mule shoe 48 defines an upward facing shoulder 50 thereon.

Mandrel 32 has a first or upper outer diameter 52, a second or first intermediate outer diameter 54 which is a threaded outer diameter 54, a third or second intermediate inner diameter 56 and a fourth or lower outer diameter 58. Shoulder 50 is defined by and extends between third and fourth outer diameters 56 and 58, respectively. Threads 60 defined on threaded diameter 54 may comprise a high strength composite buttress thread. A head or head portion 62 is threadedly connected to mandrel 32 and thus has mating buttress threads 64 thereon.

Head portion 62 has an upper end 66 that may comprise a plug or ball seat 68.

Figure 2:
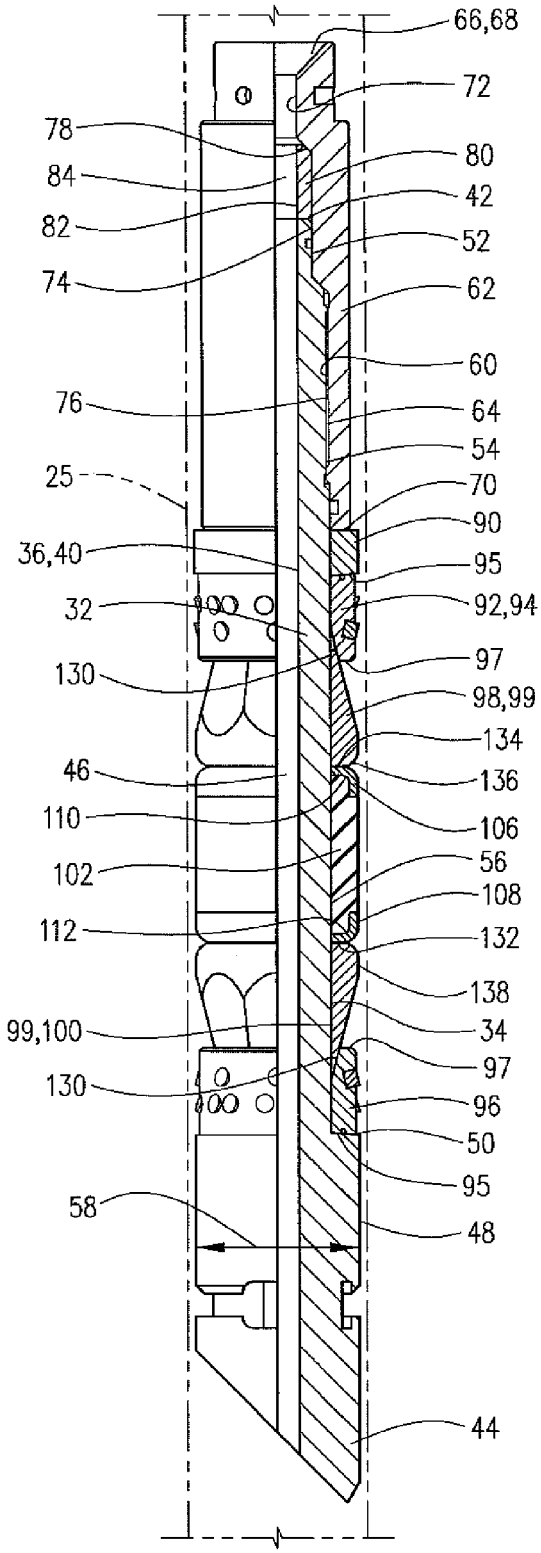
FIG. 2 is a partial section view showing an embodiment of the downhole tool.
Figure 4:
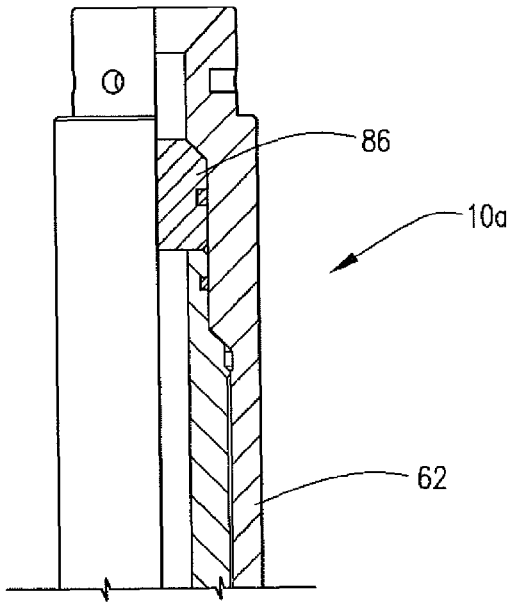
FIG. 4 shows an alternative embodiment of the upper portion of the tool.

Head 62 has lower end 70 and has first, second and third inner diameters 72, 74, 76, respectively. Buttress threads 64 are defined on third inner diameter 76. Second inner diameter 74 has a magnitude greater than first inner diameter 72 and third inner diameter 76 has a magnitude greater than second inner diameter 74. A shoulder 78 is defined by and extends between first and second inner diameters 72 and 74. Shoulder 78 and upper end 42 of mandrel 32 define an annular space 80 therebetween. In the embodiment of FIG. 2, a spacer sleeve 82 is disposed in annular space 80. Spacer sleeve 82 has an open bore 84 so that fluid may pass unobstructed therethrough into and through longitudinal central passageway 46. As will be explained in more detail, head portion 62 is easily disconnected by unthreading from mandrel 32 so that instead of spacer sleeve 82 a plug 86, which is shown in FIG. 4 may be utilized. Plug 86 will prevent flow in either direction and as such the tool depicted in FIG. 4 will act as a bridge plug.

A spacer ring 90 is disposed about mandrel 32 and abuts lower end 70 of head portion 62 so that it is axially restrained on mandrel 32. Tool 10 further comprises a pair of slip rings 92, first and second, or upper and lower slip rings 94 and 96, respectively, with first and second ends 95 and 97 disposed about mandrel 32. A pair of slip wedges 99 which may comprise first and second or upper and lower slip wedges 98 and 100 are likewise disposed about mandrel 32. Sealing element 102, which is an expandable sealing element 102, is disposed about mandrel 32 and has first and second extrusion limiters 106 and 108 fixed thereto at first and second ends 110 and 112 thereof. The embodiment of FIG. 2 has a single sealing element 102 as opposed to a multiple piece packer sealing configuration.

Figure 6:
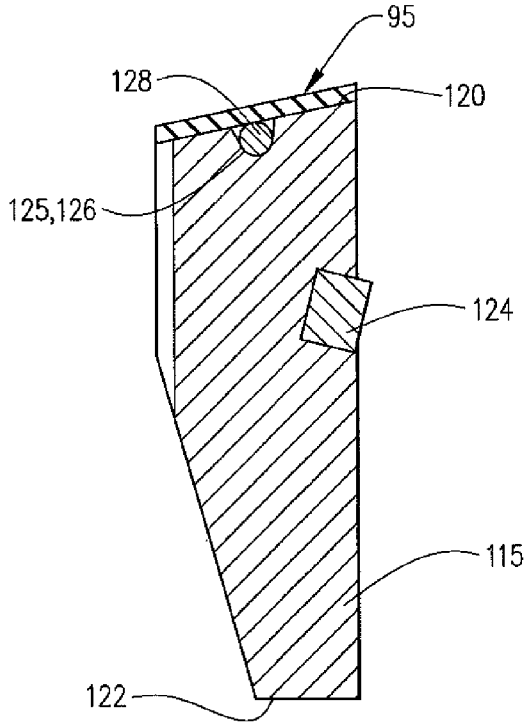
FIG. 6 shows a side view of a slip segment.
Figure 7:
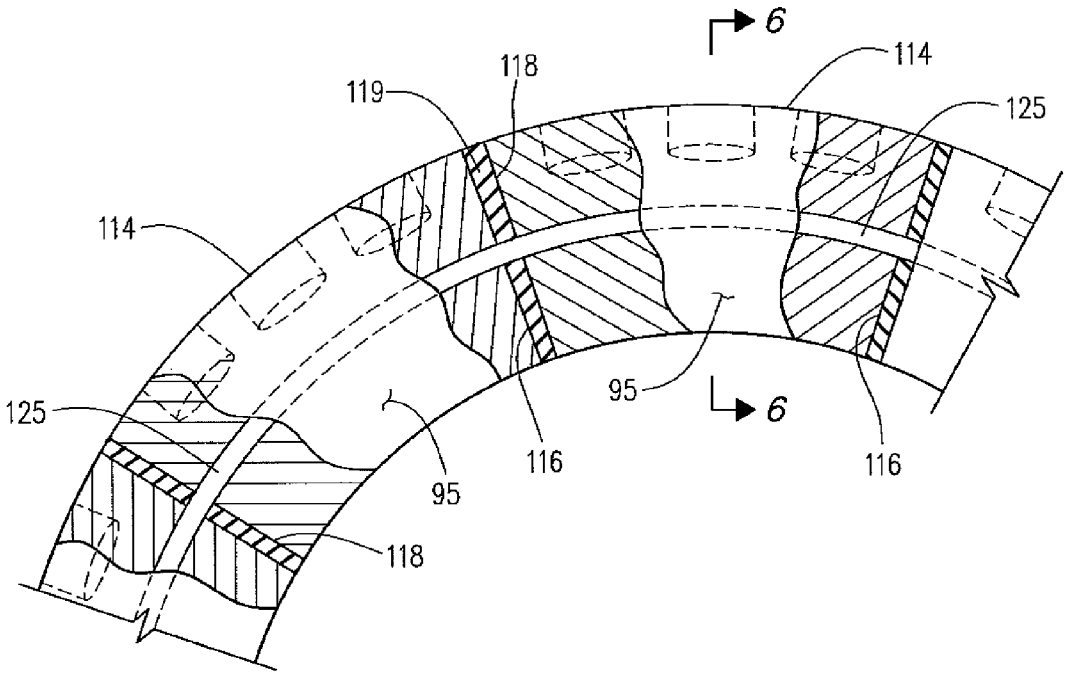
FIG. 7 is an end view of adhesively connected slip segments.

First and second slip rings 94 and 96 each comprise a plurality of slip segments 114. FIG. 6 is a cross section of a slip segment 114, and FIG. 7 shows a plurality of slip segments 114, bonded to one another. Slip segments 114 comprise a slip segment body 115 which is a drillable material, for example a woven mat of fiberglass, injected with epoxy and allowed to set. Other materials, for example molded phenolic can be used. Slip segment bodies 115 have first and second side faces or side surfaces 116 and 118 and first and second end faces or surfaces 120 and 122. Each of slip segment bodies 115 have a plurality of buttons 124 secured thereto. Thus, each of first and second slip rings 94 and 96 have a plurality of buttons 124 extending therefrom. When downhole tool 10 is moved to the set position, buttons 124 will grippingly engage casing 25 to secure tool 10 in well 15. Buttons 124 comprise a material of sufficient hardness to partially penetrate casing 25 and may be comprised of metallic-ceramic composite or other material of sufficient strength and may be for example like those described in U.S. Pat. No. 5,984,007.

Slip rings 94 and 96 each comprise a plurality of individual slip segments, for example, six or eight slip segments 114 that are bonded together at side surfaces thereof such that each side surface 118 is bonded to the adjacent slip segment 114 at side surface 116 thereof Each slip segment 114 is bonded with an adhesive material such as for example nitrile rubber. FIG. 7, which is a top view with cutaway portions, shows a layer of adhesive 119 between adjacent segments 114 to connect slip segments 114 together. Each of slip rings 94 and 96 are radially expandable from the unset to the set position shown in FIG. 3 in which slip rings 94 and 96 engage casing 25. Because individual slip segments 114 are bonded together, slip rings 94 and 96, while radially expandable, comprise indivisible slip rings with connected slip segments. Such a configuration provides advantages over the prior art in that debris will not gather between slip segments and cause the tool to hang up in the well. Thus, downhole tool 10 may be run into well 15 more quickly than prior art tools, Each of slip segment bodies 115 have grooves 125 in at least one of the end faces thereof, and in the embodiment shown in first end face 120. The ends of each groove 125 are aligned with the ends of grooves 125 in adjacent slip segments 114. Grooves 125 collectively define a groove 126 in each of slip rings 94 and 96. A retaining band 128 is disposed in each of retaining grooves 126. Grooves 126 may be of a depth such that retaining bands 128 are below the ends or end faces 120 of slip segment bodies 115. End 95 of slip rings 94 and 96 may be defined by a layer of adhesive, which may be the same adhesive utilized to bond slip segments 114 together, and may thus be, for example, nitrile rubber. The end layer of adhesive may be referred to as end layer 129. Retaining band 128 is completely encapsulated, and therefore will not be exposed to the well, or any well fluid therein. Retaining band 128 may thus be referred to as an encapsulated, or embedded retaining band 128, since it is completely covered by end layer 129. In the prior art, an uncovered retaining band was disposed in a groove around the periphery or circumference of the slip ring, which exposed the retaining band to the well. Oftentimes debris can contact such a slip ring retaining band which can damage the band so that it does not adequately hold the segments together. Thus, when a tool with the prior art configuration is lowered into the well interference may occur causing delays. Because there is no danger of slip segments 114 becoming separated and is no danger that retaining bands 128 will become hung or damaged by debris, downhole tool 10 may be run more quickly and efficiently than prior art tools.

First and second slip wedges 98 and 100 are generally identical in configuration but their orientation is reversed on mandrel 32. Slip wedges 99 have first or free end 130 and second or abutment end 132. The abutment end of first and second slip wedges 98 and 100 abut extrusion limiters 106 and 108, respectively. First end 130 of first and second slip wedges 98 and 100 is positioned radially between mandrel 32 and first and second slip rings 94 and 96, respectively, so that as is known in the art slip rings 94 and 96 will be urged radially outwardly when downhole tool 10 is moved from the unset to the set position. Abutment end 132 extends radially outwardly from outer surface 34 of mandrel 32 preferably at a 90° angle so that a flat face or flat surface 134 is defined. Abutment end 132 transitions into a radially outer surface 136 with a rounded transition or rounded corner 138 such that no sharp corners exist. Radially outer surface 136 is the surface that is the greatest radial distance from mandrel 32. Slip wedges 98 and 100 may thus be referred to as bull nosed slip wedges which will energize sealing element 102 outwardly into sealing engagement with casing 25. Because of the curved surfaces on the bull nosed slip wedges 98 and 100, the wedges provide a force that helps to push the extrusion limiters 106 and 108 radially outwardly to the casing, whereas standard wedges with a flat abutment surface apply an axial force only.

Extrusion limiters 106 and 108 are cup type extrusion limiters with an arcuate cross section. Extrusion limiters 106 and 108 may be bonded to sealing element 102 or may simply be positioned adjacent ends 110 and 112 of sealing element 102 and may be for example of composite and rubber molded construction. Extrusion limiters 106 and 108 may thus include a plurality of composite layers with adjacent layers of rubber therebetween. The outermost layers are preferably rubber, for example, nitrile rubber. Each composite layer may consist of woven fiberglass cloth impregnated with a resin, for example, epoxy. The extrusion limiters are laid up in flat configuration, cut into circular shapes and molded to a cup shape shown in cross section in FIG. 2. The flat circular shapes are placed into a mold and treated under pressure to form cup shaped extrusion limiters 106 and 108.

Figure 3:
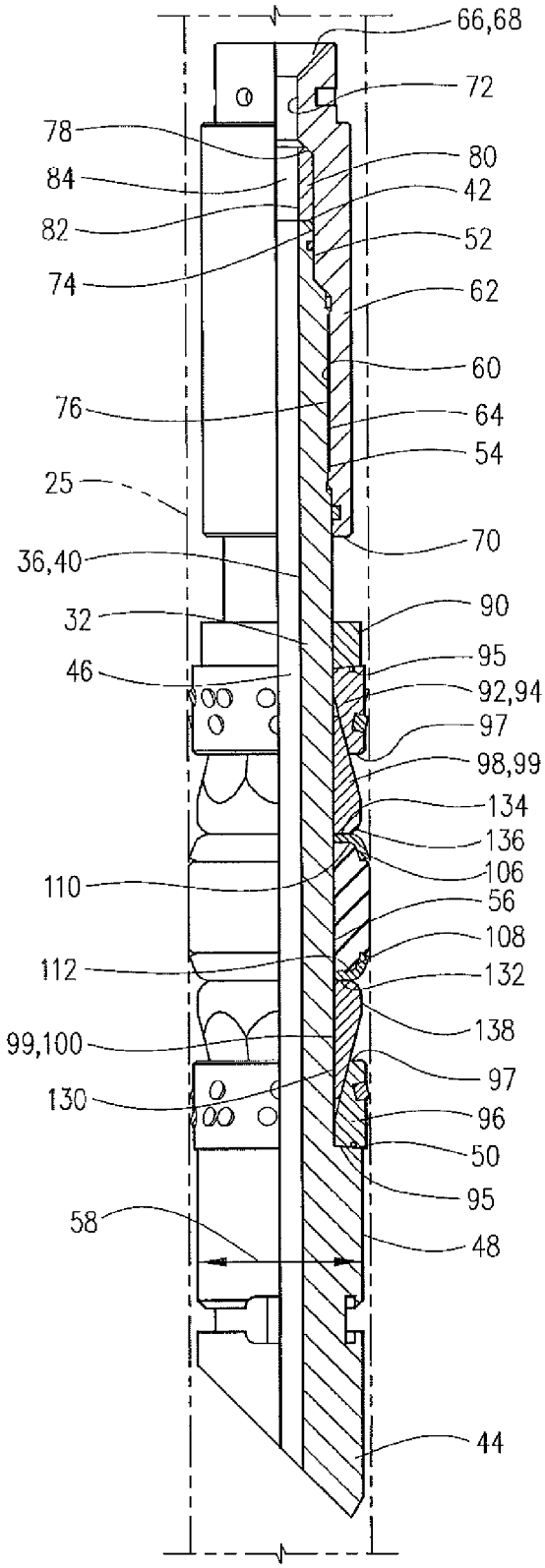
FIG. 3 shows the tool in a set position.

Downhole tool 10 is lowered into the hole in an unset position and is moved to a set position shown in FIG. 3 by means known in the art. In the set position, the slip rings 94 and 96 will move radially outwardly as they ride on slip wedges 98 and 100, respectively, due to movement of mandrel 32 relative thereto. It is known in the art that mandrel 32 will move upwardly and spacer ring 90 will be held stationary by a setting tool of the type known in the art so that slip rings 94 and 96 begin to move outwardly until each grippingly engage casing 25. Continued movement will ultimately cause slip wedges 98 and 100 to energize single sealing element 102 which will be compressed and which will expand radially outwardly so that it will sealingly engage casing 25 in well 15.

Downhole well tool 10 requires less setting force and less setting stroke than existing drillable tools. This is so because tool 10 utilizes single sealing element 102, whereas currently available drillable tools utilize a plurality of seals to engage and seal against casing in a well. Generally, drillable tools utilize a three-piece sealing element so downhole tool 10 uses one-third less force and has one-third less stroke than typically might be required. For example, known drillable four and one-half or five and one-half inch downhole tools utilizing a three-piece sealing element generally require about 33,000 pounds of setting force and about a 5 ½-inch stroke. Downhole tool 10 will require 22,000 to 24,000 pounds of setting force and a 3 ½ to 4-inch stroke. As downhole tool 10 is set, extrusion limiters 106 and 108 will deform or fold outwardly. Extrusion limiters 106 and 108 will thus be moved into engagement with casing 25 and will prevent seal 102 from extruding therearound.

Retaining bands 128 are protected from being broken because they are not exposed to well fluid or debris in the well. The non-exposed retaining bands, in addition to slip rings 94 and 96 which have segments that are attached to one another to lessen any fluid drag and to prevent debris from hanging up between segments allow downhole tool 10 to be run in at higher speeds. Because there is less risk of sticking in the well due to such causes, downhole tool 10 may be run into the well much more quickly and efficiently. Generally, tools using segment slips are lowered into a well at a rate of about 125 to 150 feet/minute, Tests have indicated that downhole tool 10 may be run at speeds in excess of 500 feet/minute.

The thread utilized to connect head portion 62 to mandrel 32 is adapted to withstand forces that may be experienced in the well and is rated for at least 10,000 psi, and must be able to withstand about 55,000 pounds of tensile downhole load for a 4 ½ or 5 ½ inch tool. Typically, threaded composites are unable to withstand such pressures. In addition, because head portion 62 is threadedly connected and may be easily disconnected, downhole tool 10 may be used in many configurations. In the configuration shown in FIG. 2, downhole tool 10 may be set in the well and utilized as a frac plug simply by dropping a sealing ball or sealing plug of a type known in the art into the well so that it will engage the seat 68. Once the sealing ball is engaged, fluid may be pumped into the well and forced into a formation above downhole tool 10. Once the desired treatment has been performed above downhole tool 10, the fluid pressure may be decreased and the fluid from a formation below downhole tool 10 is allowed to pass upwardly through downhole tool 10 to the surface along with any fluid from formations thereabove.

FIG. 4 shows the upper portion of a downhole tool **10*a* which is identical in all respects to downhole tool 10 except that plug 86 has been positioned in annular space 80. When tool 10*a* is set in the well, fluid flow in both directions is prevented so that downhole tool 10*a* acts as a bridge plug. As is apparent, the downhole tool is convertible from and between the frac plug configuration shown in FIG. 2 and the bridge plug configuration shown in FIG. 4 simply by unthreading head portion 62 and inserting either spacer sleeve 22 or plug 86** depending upon the configuration that is desired.

Figure 5:
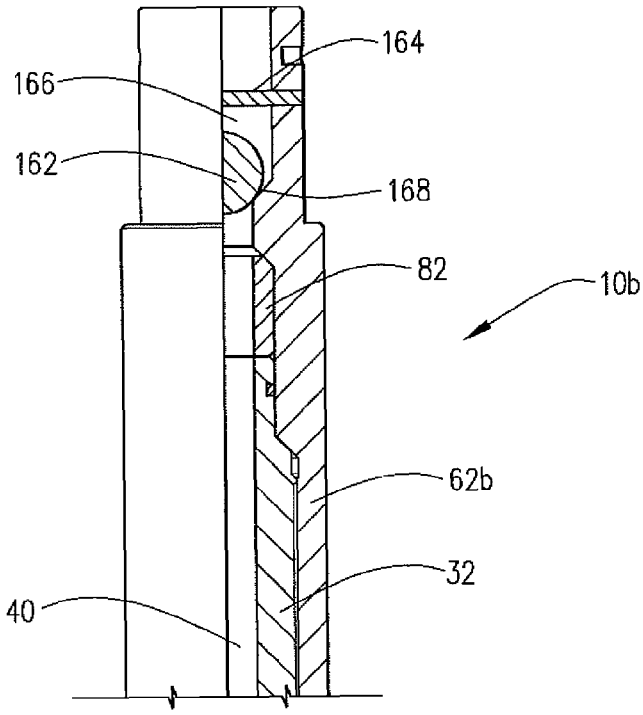
FIG. 5 is a partial cross section showing an additional embodiment.

FIG. 5 shows an embodiment referred to as downhole tool **10*b* which is identical in all respects to that shown in FIG. 2** except that the head portion thereof, which may be referred to as head portion 62*b*, has a cage portion 160 to entrap a sealing ball 162. Sealing ball 162 is movable in cage portion 160. A pin or other barrier 164 extends across a bore 166 of cage portion 160 and will allow fluid flow therethrough into the bore 40 of mandrel 32. Downhole tool 10*b* is a frac plug and does not require a ball or other plug dropped from the surface since sealing ball 162 is carried with tool 10*b* into the well. When tool 10*b* is set in the hole, fluid pressure from above will cause sealing ball 162 to engage the seat 168 in cage portion 160 and fluid may be forced into a formation thereabove. When treatment above tool 10*b* has been completed, fluid pressure may be relieved and fluid from below downhole tool 10 may flow therethrough past sealing ball 162 and bore 166 upwardly in the well. While FIGS. 2, 4 and 5 all show the use of first and second, or upper and lower extrusion limiters 106 and 108, when the downhole tool is utilized as a frac plug, the upper extrusion limiter 106 may be excluded.

Figure 10:
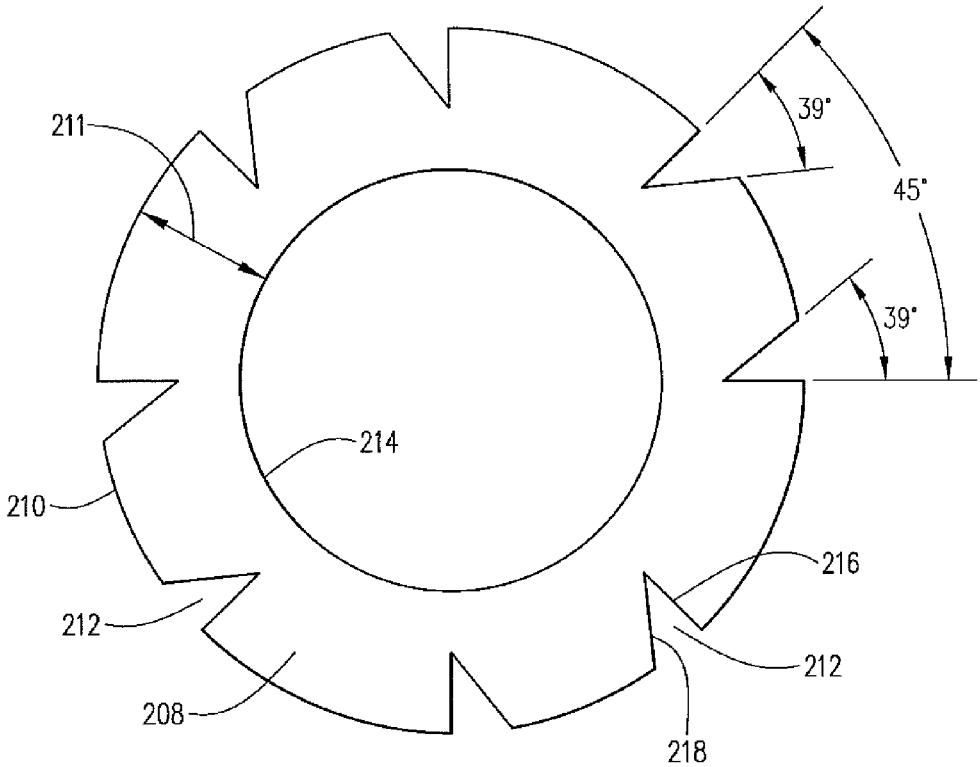
FIG. 10 is a top view of a single disc used in an extrusion limiter.
Figure 11:
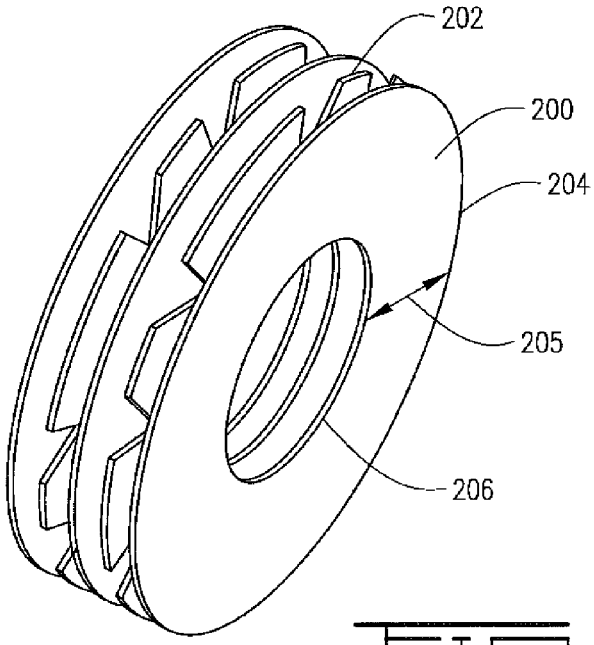
FIG. 11 is a perspective view showing alternating layers that may be used to form the extrusion limiters described herein.

A particular embodiment for extrusion limiters 106 and 108 is shown in FIGS. 8-11. As previously described, extrusion limiters 106 and 108 comprise a plurality of alternating layers of different types of materials. FIG. 11 shows a perspective view of layers that may be utilized to form extrusion limiters 106 and 108. The layers are shown prior to shaping or molding the extrusion limiters into their final shape which is the cup shape shown in FIGS. 2 and 3. Extrusion limiters 106 may include alternating layers 200 and 202 which may be referred to as first layers 200 and second layers 202. First and second layers 200 and 202 are comprised of different materials and as previously described, layers 200 are preferably comprised of rubber, for example, nitrile rubber while layers 202 may comprise composite layers consisting of woven fiberglass cloth impregnated with a resin. First layers 200 may be discs with an outer peripheral edge 204 and an inner peripheral edge 206 defining a span, or distance 205 therebetween. Outer and inner peripheral edges 204 and 206 may be a regular geometric shape, such as for example, circular, hexagonal, octagonal or other regular geometric shape. In the embodiment shown, first layers 200 may be described as generally circular rings or discs with an outer peripheral edge 204 that is a circular outer peripheral edge and an inner peripheral edge 206 that is a circular inner peripheral edge. Outer peripheral edge 204 may be an irregular shape as well, comprising a plurality of connected segments that do not define a particular geometric shape. Inner peripheral edge 206 defines an opening that is closely received about mandrel 32.

Second layers 202 comprise at least one disc 208. Disc 208 has outer peripheral edge 210 and inner peripheral edge 214 with span 211 therebetween. Inner peripheral edge 214 defines an opening adapted to be closely received about mandrel 32, and in the embodiment shown is a circular inner peripheral edge 214.

Outer peripheral edge 210 may define a regular geometric shape, with cutouts 212 therein that extend radially inwardly toward inner peripheral edge 214, The embodiment shown includes circular outer peripheral edge 210 with cutouts 212 that extend toward inner peripheral edge 214. Cutouts 212 are shown as generally triangularly shaped cutouts but may be other shapes as well. While outer peripheral edge 210 is shown as a circular outer peripheral edge with cutouts 212 therein, it is understood that outer peripheral edge 210 may comprise other regular geometric shapes, such as hexagonal, octagonal or other regular geometric shape, with cutouts therein, Outer peripheral edge 210 may also comprise a plurality of connected segments 217, wherein the distance from end points 219 of segments 217 to the inner peripheral edge 214 is not a constant distance. A flat view of an embodiment of disc 208 is shown in FIG. 10.

Figure 8:
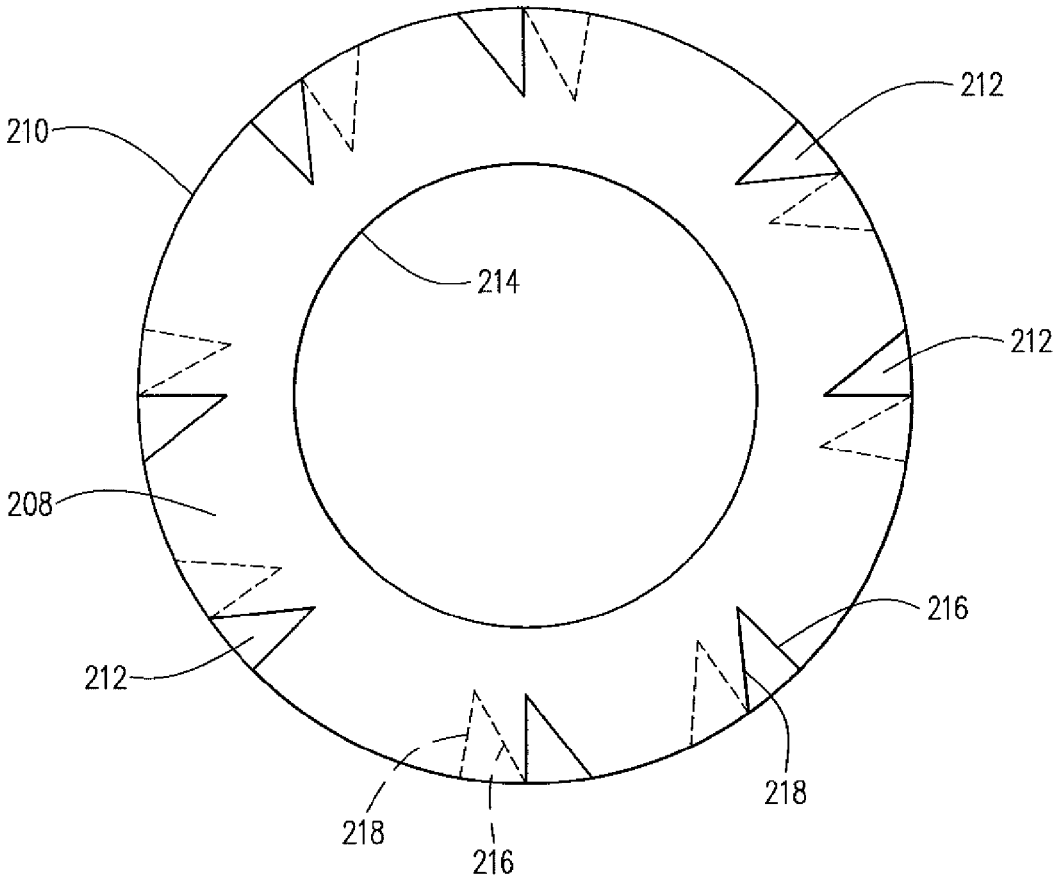
FIG. 8 is a top view of a plurality of discs utilized to make up a layer of an extrusion limiter.
Figure 8:
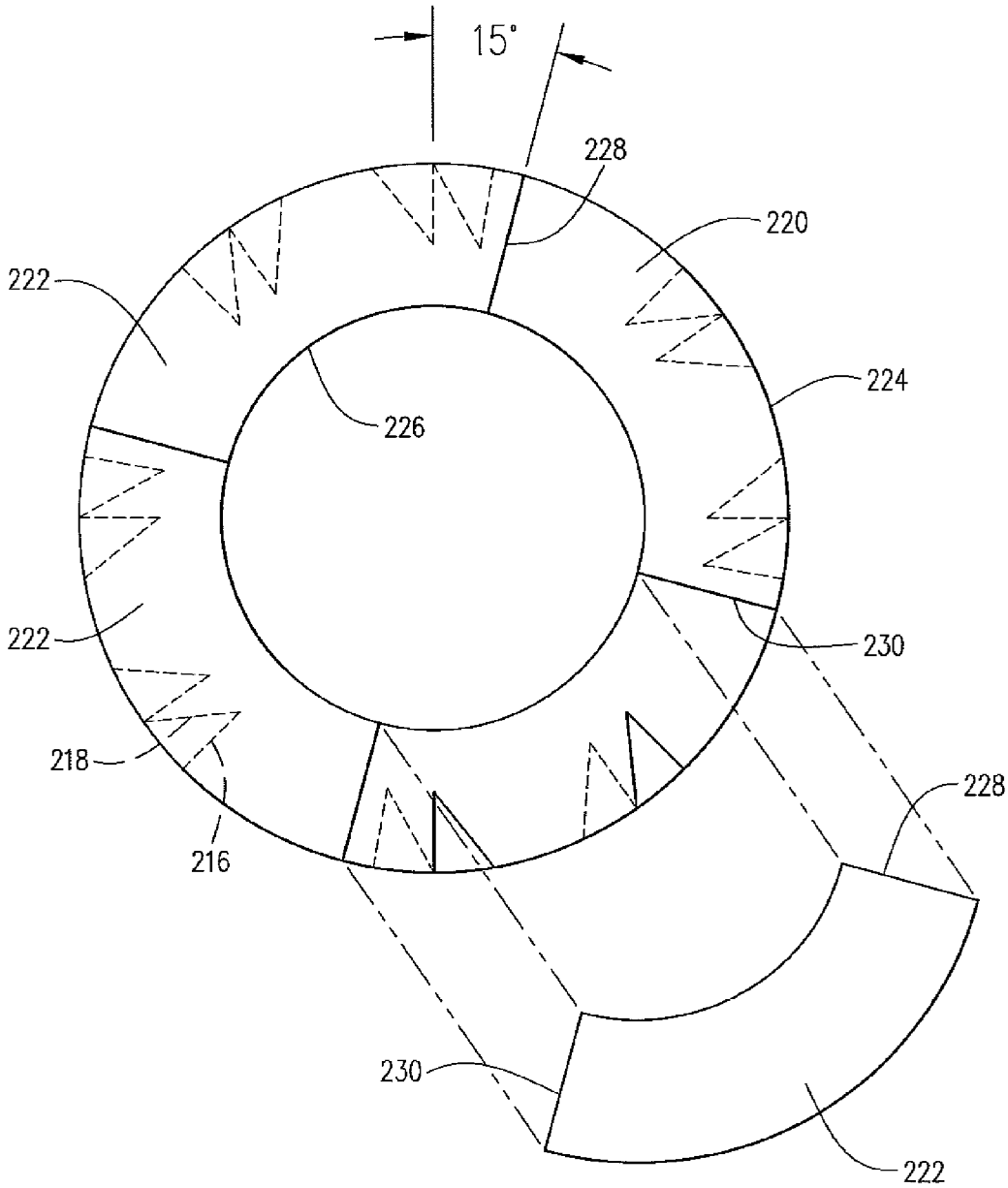

While FIG. 10 shows a single disc 208, second layers 202 may include a plurality of discs. Second layers 202 may for example include a plurality of discs 208. FIG, 8 shows one of the discs 208 stacked with another of the discs 208. In the embodiment shown, the discs 208 are arranged such that cutout edges 216 and 218 of each of the discs 208 are offset or misaligned with the cutout edges 216 and 218 of the other of the discs 208 in a layer 202. FIG. 8 shows cutouts 212 offset such that there is no overlap between cutout edges but it is understood that there may be some overlap so long as cutout edges 216 and 218 of one of discs 208 do not align with the cutout edges 216 and 218 of any of the other discs 208 in a layer 202. FIG. 8 shows two discs 208 and it is understood that layer 202 may include more than two of discs 208 and that the cutout edges 216 and 218 of each of the discs 208 should not align and should be offset from the cutout edges 216 and 218 in all of the other discs 208 in a single layer 202, Cutouts 212, and thus cutout edges 216 and 218 extend radially inwardly from outer peripheral edge 210 toward inner peripheral edge 214. Each layer 202 may in addition to discs 208 include a segmented disc 220. Segmented disc 220 is shown in FIG. 9 and preferably comprises four equal segments 222. The four equal segments are positioned adjacent one another and comprise a generally circular or ring-shaped disc 220 with outer peripheral edge 224 which may be a circular peripheral edge 224 and inner peripheral edge 226 which may be a circular inner peripheral edge. Peripheral edges 224 and 226 define a span 225 therebetween. Segments 222 have first and second side edges 228 and 230. Segmented disc 220 is oriented such that segment side edges 228 and 230 are offset from all of the cutout edges and thus do not align with any of cutout edges 216 and 218. Although segmented disc 220 is shown as having a circular outer peripheral edge, it is understood that other shapes for the outer peripheral edge may be used.

Extrusion limiters 106 and 108 are laid up in a flat configuration as shown in FIG, 11. Each of the layers alternate such that a layer 202 is positioned between two layers 200. Layers 202 are thus positioned adjacent layers 200 and are stacked therewith. Preferably, the outer layers are nitrile rubber layers 200 and inner layers 202 are fiberglass layers as previously described. Each of discs 208 and 220 are thus fiberglass layers. When a plurality of discs are used for layers 202, the discs are stacked together. Once the layers are laid up and oriented, the layers 200 and 202 are molded into the cup shape shown in cross section in FIG. 2, Preferably, layers 200 and 202 are stacked and are placed into a mold and treated under heat and pressure to form the cup-shaped extrusion limiters which not only forms into the final shape shown in FIG. 2 but bonds the layers 200 and 202 together. In the set position of the tool, the extrusion limiters will straighten slightly and will expand outwardly to move closer to and preferably to engage the wellbore to prevent extrusion therearound.

It will be seen therefore, that the present invention is well adapted to carry out the ends and advantages mentioned, as well as those inherent therein, While the presently preferred embodiment of the apparatus has been shown for the purposes of this disclosure, numerous changes in the arrangement and construction of parts may be made by those skilled in the art. All of such changes are encompassed within the scope and spirit of the appended claims.

What is claimed is:

1. An extrusion limiter for use in a downhole tool comprising;

a plurality of alternating first and second layers; the first layers comprise of a rubber and the second layers comprise of a second material different from the rubber, wherein prior to shaping the extrusion limiter to a final shape the first layers comprise generally flat discs with an outer peripheral edge and an inner peripheral edge and a span therebetween, and each second layer comprises a plurality of stacked, generally flat discs having outer and inner peripheral edges defining a span therebetween and having a plurality of cutouts extending therefrom towards the inner peripheral edge wherein all of the discs in the second layer are fiberglass.

2. The extrusion limiter of claim 1, wherein at least one of the discs in the second layer has an outer peripheral edge comprising a regular geometric shape with the cutouts extending radially inwardly therefrom.

3. The extrusion limiter of claim 2, wherein the outer peripheral edge comprises a circular outer peripheral edge.

4. The extrusion limiter of claim 3, each second layer comprising at least one of the flat discs with cutouts in the circular outer peripheral edge thereof and at least one flat, segmented ring-shaped disc stacked therewith, wherein the segmented ring-shaped discs comprises a plurality of segments defining segment edges positioned adjacent one another and is oriented such that the segment edges are offset from all of the cutout edges.

5. The extrusion limiter of claim 4, wherein the second layers each comprise a plurality of the flat discs with cutouts in the circular outer peripheral edge and at least one of the segmented ring-shaped discs, stacked and oriented so that the cutout edges of each disc with cutouts in the outer peripheral edge are offset from the cutout edges in each of the other of the discs with cutouts in the outer peripheral edge and the segment edges are offset from all of the cutout edges.

6. The extrusion limiter of claim 4, wherein the first layers are the outer layers.

7. A downhole tool for use in a well comprising:

a mandrel;

a sealing element having first and second ends disposed about the mandrel, the sealing element being expandable from an unset position to a set position in which the sealing element engages the tool;

first and second extrusion limiters at the first and second ends of the sealing element, the first and second extrusion limiters comprising a plurality of alternating first and second layers, the first layers comprised of a first material and the second layers comprise of second material different form the first material, wherein prior to shaping the extrusion limiter to a final shape the first layers comprise generally flat discs with an outer peripheral edge and circular inner peripheral edge defining a span therebetween, and the second layers comprise a plurality of generally flat discs each having an inner peripheral edge and an outer peripheral edge defining a span therebetween, the outer peripheral edge of the discs in the second layers comprising a regular geometric shape with a plurality of cutouts extending radially inwardly therefrom.

8. The downhole tool of claim 7, wherein the outer peripheral edge comprises a generally circular outer peripheral edge shape with the plurality of cutouts therein, the cutouts defining cutout edges.

9. The downhole tool of claim 8, wherein the plurality of cutouts in the outer peripheral edge are generally triangular in shape.

10. The downhole tool of claim 8, wherein the second layers each comprise at least one of the flat discs with cutouts in the circular outer peripheral edge thereof and at least one flat segmented disc stacked therein; the segmented disc comprising a plurality of segments with segment side edges positioned adjacent one another wherein all segment sides are offset from the cutout edges.

11. The downhold tool of claim 10, wherein the plurality of discs comprises a plurality of the discs with cutouts in the circular outer peripheral edge and at least one of the discs segmented all of the discs being stacked and oriented such that no segment edge aligns with a cutout edge and the cutout edges in each disc are offset from the cutout edges in the other of the discs.

12. The downhole tool of claim 7, wherein the first and second extrusion limiters have an arcuately shaped cross section in the unset position of the tool.

13. The downhole tool of claim 12, wherein the extrusion limiter at least partially straighten when the tool moves to the set position to engage the well and limited extrusion of the sealing elements.

14. The downhole tool of claim 7, wherein the first material is nitrile rubber and the second material is a fiberglass composite.

15. A downhole tool of claim 7, further comprising first and second slip wedges disposed about the mandrel, each having an abutment end, wherein the first and second slip wedges abuts the first and second extrusion limiters.

16. A downhole tool of claim 15, wherein the abutment end of each slip wedge comprises a flat portion extending radially outwardly from a mandrel outer surface and a rounded transition from the flat portion to a radially outer surface on the slip wedge.

17. The apparatus of claim 15, wherein the abutment ends of the first and second slip wedges compress the sealing element seal and move the sealing element to the set position.

* * * * *